United States Patent [19]

Hasselbach et al.

[11] Patent Number: 5,059,455

[45] Date of Patent: Oct. 22, 1991

[54] METHOD FOR GALVANIZING PERFORATED STEEL SHEET

[75] Inventors: LaVurne R. Hasselbach; Donald P. Kennedy, both of Dover; Roger H. Montgomery; Samuel W. Moore, both of New Philadelphia; Jack W. Neiger, Tuscarawas, all of Ohio

[73] Assignee: Cyclops Corporation, Pittsburgh, Pa.

[21] Appl. No.: 165,208

[22] Filed: Mar. 8, 1988

[51] Int. Cl.[5] ..... B05D 3/00

[52] U.S. Cl. ..... 427/292; 204/29; 204/34

[58] Field of Search ..... 427/292, 433; 72/203; 204/29.34

[56] References Cited

U.S. PATENT DOCUMENTS 2,103,119 12/1937 Romanoff ..... 148/61.15 R
2,348,283 5/1944 Dolar ..... 72/203

OTHER PUBLICATIONS

Materials Protection and Performance, 2/72, pp. 37–40, Hettleman.
Anti Corrosion, 10–78, vol. 25, #10.
"The Making Shaping and Testing of Steel", p. 910, 1964.
"Metal Finishing", p. 99, 1969.

*Primary Examiner*—Sam Silverberg
*Attorney, Agent, or Firm*—Kirkpatrick & Lockhart

[57] ABSTRACT

A process for producing a galvanized perforated steel sheet material is described. A fully processed, unfinished sheet steel material is perforated to provide an area or areas of holes therein. The sheet material is then temper rolled to force any burrs formed during the perforation process back into the web of the material. The perforated sheet material is then galvanized. The galvanized perforated sheet material may then be roll painted without damage to the painting rolls.

23 Claims, 1 Drawing Sheet

METHOD FOR GALVANIZING PERFORATED STEEL SHEET

BACKGROUND OF THE INVENTION

1. Field of the Invention

The present invention relates to the manufacture of galvanized perforated steel sheet product and, in particular, to a process for perforating, temper rolling and subsequently galvanizing a steel sheet.

2. Description of the Prior Art

In the metals producing industry, it is known that, if the surface of a steel product is left unprotected after finishing, such surface will be readily subject to oxidation or, as that process is more commonly known, rusting. In the oxidation process, the surface of a steel product is transformed from a unitary steel surface to one having visible areas of oxidation over the steel. The oxidation of a steel product serves to decrease its strength and to severely degrade its appearance, and eventually destroy the product.

One process which has been developed in an effort to prevent oxidation is galvanizing. In a galvanizing operation, a layer of sacrificial zinc material is applied over the steel's surface. An intermediate layer comprised of a zinc-steel alloy is formed at the zinc-steel interface. As such, the zinc covers the steel's surface and prevents the oxidation of the steel by allowing instead the oxidation of the zinc, which proceeds at a markedly slower pace than the oxidation of the steel.

While it is known to galvanize or otherwise protect the surfaces of various steel products prior to or following their formation into more usable forms, it has not been heretofore known to perforate a steel sheet or strip prior to galvanizing and eventually painting and forming into finished products. Applicants have discovered that a galvanized perforated steel sheet product may be effectively produced by sequentially temper rolling the steel sheet, perforating the sheet to a considerable extent across its surface, again temper rolling the sheet to reduce any burrs and shape defects produced in the sheet by the perforating process, galvanizing the perforated sheet, optionally temper rolling the sheet to smooth the surface and minimize the appearance of spangles in the surface of the sheet and optionally coating the sheet.

That the prior art does not contemplate the process discovered by Applicants is obvious from a review of such art. In an article by M. K. Hettleman entitled "Designing and Fabricating Steel Structures and Assemblies to be Hot Dip Galvanized After Fabrication", Materials Protection and Performance, Feb., 1972, pp. 37–40, the author states that bending, forming and punching of steel structures should be done before galvanizing. Id. at 40. However, such article does not disclose or suggest the perforating of a steel sheet across a substantial portion of its surface and then temper rolling the sheet prior to galvanizing.

That those skilled in the art were unaware of the benefits of perforating a steel sheet prior to galvanizing it is shown from a review of German Pat. No. 31 17 982. That patent, laid open in 1982, relates to a process for producing galvanized, perforated sheet steel which comprises, in sequence, galvanizing the sheet, perforating the sheet and then regalvanizing the sheet. As such, the German Patent shows that it was previously unknown in the art to first perforate the sheet and then galvanize it to avoid such redundant operations.

One patent in which a metal object was perforated prior to the application of a coating metal substance thereover is Great Britain Pat. No. 14,071. According to that patent, a metal object is perforated to provide large perforations, e.g., ¼to 3 inches in diameter, and then a coating of lead is applied thereto. However, the British Patent clearly states that the perforations are filled with the coating lead so as to provide pins joining the coatings on the outer sides of the object. Hence, the British Patent does not teach perforating and subsequently galvanizing a steel sheet to provide a final galvanized, perforated steel sheet product.

As noted above, the subject invention is directed toward a method for producing a galvanized perforated steel sheet product in which the sheet is perforated, then temper rolled and then galvanized. Such process overcomes, among others, the above-discussed problems present with prior art processes and which efficiently and effectively produces a galvanized perforated steel sheet product. In particular, the present invention provides a perforated steel sheet having a protective metallic coating over its entire surface, whereas, in accordance with the prior art practice of galvanizing and then perforating a steel sheet, the perforating process removes the galvanized coating from the inner surfaces of the perforations.

SUMMARY OF THE INVENTION

In accordance with the present invention, there is provided a method for producing a galvanized steel sheet product having perforations across a substantial portion of the width thereof. A fully processed low carbon rim cold rolled steel sheet in a coil which has been temper rolled to impart surface texture is perforated across a substantial portion of its width. The perforation process may include the sequential perforating and indexing of the steel sheet.

The steel sheet is then temper rolled to force the burrs formed by the perforation process back onto the steel sheet as well as to improve sheet thickness and shape uniformity and surface texture.

The steel sheet is next galvanized on a conventional continuous hot dip galvanizing line. In particular, the sheet is cleaned, a fluxing agent is applied thereto to aid in zinc bonding, the sheet is dried and then preheated. Thereafter, the sheet is passed through a molten zinc bath to apply a zinc coating to both sides of the sheet. The application thickness of the zinc coating is controlled by conventional air knives.

The galvanized sheet is then cooled, quenched to enhance the physical properties of the steel and dried. Thereafter, the steel sheet may be optionally temper rolled in single or multiple passes to smooth the surface and control the appearance of zinc spangles on the surface of the sheet.

The galvanized perforated steel sheet in coil form thus produced may then have a coating material such as paint applied thereto. The paint may be applied by rolling the paint onto the sheet.

By the use of the subject process, a galvanized perforated steel sheet product, which may be painted without damage to paint rollers, is produced. As this invention provides a galvanized perforated steel sheet product having complete galvanization, the problems present in prior art steel sheet producing methods are alleviated.

These and other details, objects and advantages of the invention will become apparent as the following description of the present preferred embodiment thereof proceeds.

BRIEF DESCRIPTION OF THE DRAWINGS

In the accompanying drawing, I have shown a present preferred embodiment of certain components of the apparatus for accomplishing the method of the present invention wherein.

DETAILED DESCRIPTION OF THE PREFERRED EMBODIMENT

Figure 1:
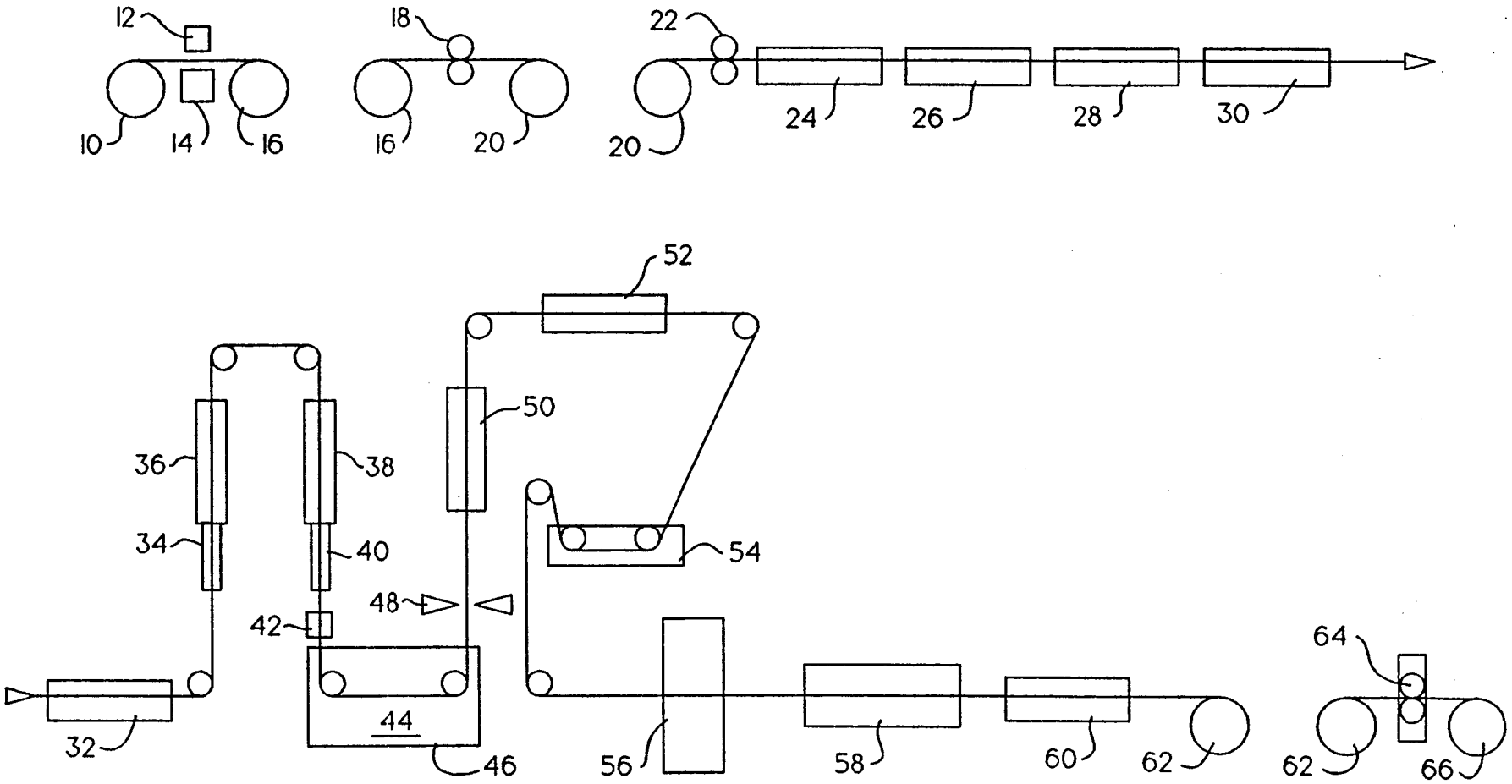
FIG. 1 is a side elevation schematic view of certain components of the apparatus for accomplishing this invention.

The present invention relates to a method for processing sheet steel material to produce a galvanized perforated steel sheet product which may optionally be coated as by roll painting. The material on which the method according to the present invention is practiced may comprise any sheet steel material. In particular, the material may comprise fully processed, low carbon rim cold rolled sheet steel in coils 10. Such material may, for example, be AISI steel grades 1006–1008, of a thickness of between 0.0150 to 0.075 inches and may be of a width between 18 and 48 inches. While the term "fully-processed" is understood by those skilled in the art, such term preferably includes steel sheet which has been annealed and temper rolled to impart a desired surface texture, to impart additional work hardening and to improve its shape.

A coil of the steel sheet material 10 is then passed through appropriate apparatus to produce perforations therein. Such apparatus may include a corresponding punch 12 and die 14 set through which the sheet material 10 is sequentially passed. After each incremental length of sheet material 10 is perforated, the material 10 is indexed to allow the punch 12 and die 14 set to perforate the next incremental length until the entire length of the material 10 is perforated. The perforated material is then recoiled into a coil 16. It will be appreciated that other perforation processes are contemplated herein such as continuous perforation processes. In any event, the perforation process employed imparts a significant amount of perforations into the material 10. The perforating process may perforate the material 10 across its entire width or may perforate the material 10 so as to provide alternating longitudinal strips of unperforated and perforated material. In the perforated areas of material 10, the perforations preferably provide 15–23% open area. The perforations are preferably round, but may alternatively be square, triangular or elliptical in shape.

The coil of perforated material 16 is then passed through a conventional temper rolling mill 18 to accomplish several goals. First, the temper rolling mill 18 forces any burrs formed around the perforations in material 16 back into the body of such material. Temper rolling also improves the thickness uniformity of the material 16, improves its shape and presents the desired surface texture on perforated material 16. The steel sheet material following temper rolling 20 is recoiled into coil form.

The sheet material 20 which has been previously perforated and temper rolled is then subjected to a coating process to impart a metallic coating thereto. Such a process may comprise galvanizing, preferably by a hot dip galvanizing process, to impart a surface coating of zinc. It will also be appreciated that, in lieu of a galvanizing process, the sheet material may be otherwise processed to provide a metallic coating on the surfaces thereof. As such, the sheet material 20 may alternatively be subjected to the GALFAN®process in which a coating of predominantly zinc with aluminum added thereto is applied to the sheet material 20. Alternatively, the sheet material 20 may be coated in a Galvalum process to apply a coating of 55% zinc and 45% aluminum. Also, the sheet material 20 may be Type 1 aluminized to provide an aluminum coating or Type 2 aluminized to provided a coating of silica and aluminum. Further, the sheet material 20 may have a lead coating applied thereto. It will be further appreciated that the metal coating applied to the sheet material 20 may be applied, in manners known to those skilled in the art, by hot dip processing, electrolytic deposition of the metallic coating or metallic spray coating. In any event, Applicants have discovered that, because, in accordance with the present invention, the steel sheet has been perforated prior to the application of a metallic coating, the coating covers the inner surfaces of the perforations to protect them. The prior art processes have simply not recognized the desirability of perforating a steel sheet prior to the application of a metallic coating to avoid redundant operations.

For the purposes of the present Detailed Description of the Preferred Embodiments of the Invention, reference will be made to a conventional continuous hot dip galvanizing process, known to those skilled in the art. In such a process, the coil of sheet material 20 is uncoiled and passed through feed rollers 22. The sheet material 20 is then prepared for galvanizing by passing it first through an acid bath 24 containing, for example, 14% hydrochloric acid in water. The sheet material 20 is then passed through water sprays and brush scrubbers, in known fashion, to remove excess acid. The sheet material 20 is then passed through an alkali bath 26 containing predominantly sodium hydroxide and through a related brush scrubbing apparatus to remove residue from the alkali bath 26.

The sheet material 20 is then preferably passed through an electrolytic cleaning apparatus 28. Such apparatus serves to electrolytically clean the surfaces of sheet material 20 in a manner known to those skilled in the art. The sheet material 20 is then passed through brush scrubbing and water rinse units associated with electrolytic cleaning apparatus 28. The sheet material 20 is next preferably passed through a second acid bath 30 containing approximately 10% hydrochloric acid in water and its associated water sprays and brush scrubbers to further clean its surfaces.

The sheet material 20 is then passed into a flux tank 32. Flux tank 32 contains an aqueous solution of zinc chloride and ammonium chloride with appropriate surfactants or wetting agents. Such solution, when dried, is intended to enhance the bonding of the zinc applied to the surfaces of the sheet material 20 during the galvanizing process. The fluxing agents applied to sheet material 20 are then dried and the sheet material 20 is preheated by passing it through flux drying ovens 34 and 36 which are maintained at a temperature between 1000–1100° F., and preheat ovens 38 and 40 which are maintained at similar temperatures. As a result of the sheet material 20 passing through ovens 34, 36 38 and 40, the fluxing agents are dried and the strip preferably preheated to a temperature between 425° and 525° F.

The sheet material 20 then passes through a fume scrubber 42 which captures the fumes generated when the sheet material 20 is input into the zinc bath 44 contained within a galvanizing tank 46. The zinc bath 44 comprises spelter which is 98.9% pure zinc with added aluminum, which bath is maintained at approximately 860° F. The sheet material 20 is immersed within the zinc bath 44 so that a zinc coating is applied to all surfaces thereof. Upon its exit from the zinc bath 44, the sheet material 20 passes through air knives 48 which control the thickness of the zinc coating in known manner. The final zinc coating on both sides of sheet material 20 is preferably between 0.0005 and 0.0014 inches in thickness.

The sheet material 20 is then passed through a first cooling hood 50, second cooling hoods 52 (only one of which is shown in FIG. 1) and into a quench cooling tank 54 containing primarily cooling water. As a result, temperature of the sheet material 20 is returned to approximately ambient temperature. The sheet material 20 is then dried by known means. The strip material 20 may then be passed through a surface conditioning mill 56 if the zinc spangles formed on its surface during galvanizing are to be minimized. The sheet material 20 may then be passed through a tension leveling mill 58 to improve its shape. The sheet material 20 may then be chemically treated in a chemical treat tank 60 or coiled, either in conventional fashion, depending on the intended use of the sheet material 20. The sheet material 20 is then either recoiled into a coil 62 or cut to finished length.

If an additional surface coating is to be applied to the sheet material 20, it is again passed, as needed, through a temper rolling mill to control spangle appearance. Additionally, the surfaces of the sheet material 20 may then be prepared for receipt of a coating as by alkaline cleaning and the application of a bonderizer. A coating material such as paint may be applied to the sheet material 20 by known means such as roll coating or spraying; however, other known finish coating substances and methods are also contempled under the present invention. The present invention produces a steel sheet material which is especially well suited for painting by roll coating means wherein the coil 62 of galvanized perforated sheet material is uncoiled, rolls 64 apply paint to the sheet material and the material is rewound into a coil 66. As any burrs formed during the perforation process have been previously eliminated by the temper rolling discussed above, and the galvanized perforated sheet material will not harm the paint rollers 64. It will be understood that the perforating, temper rolling, galvanizing and roll painting steps described hereinabove may be conducted as discrete steps with the sheet material being uncoiled and recoiled in each step. However, preferably, all such steps may be continuously performed on a single unwound coil of sheet material.

It will be understood that various changes in the details, materials and arrangements on parts which have been herein described and illustrated in order to explain the nature of the invention may be made by those skilled in the art within the principle and scope of the invention as expressed in the appended claims.

What is claimed is:

1. A method of producing a metallic coated perforated metallic sheet product comprising the steps of, in sequence:

a. perforating an uncoated, flat rolled metallic elongated sheet to provide a plurality of perforations in the web thereof;

b. passing the metallic sheet through a rolling mill to reduce any burrs formed around the perforations and improve the surface finish and shape of said metallic sheet; and c. continuously applying a metallic coating to said metallic sheet.

2. The method of claim 1 in which said metallic coating is applied by a hot dip metallic coating application process.

3. The method of claim 1 in which said metallic coating is applied by an electrolytic metallic coating application process.

4. The method of claim 1 in which said metallic coating is applied by a spray metallic coating application process.

5. The method of claim 1 in which said step of perforating said metallic sheet is practiced upon incremental lengths of said metallic sheet and said metallic sheet is indexed to provide an incremental unperforated length which may then be perforated.

6. The method of claim 1 further comprising the step of applying a coating later to said metallic sheet after said metallic coating is applied.

7. The method of claim 6 in which said step of applying a coating layer comprises the application of paint to said metallic sheet by a roll paint application process.

8. A method of producing a metallic coated elongated steel sheet product comprising the steps of, in sequence:

a. perforating an elongated, uncoated flat rolled steel sheet to provide a plurality of perforations in the web thereof;

b. passing the steel sheet through a rolling mill to reduce any burrs formed around the perforations and improve the surface finish and shape of said steel sheet; and c. continuously applying a metallic coating to said steel sheet.

9. The method of claim 8 in which said metallic coating is applied by a hot dip metallic coating application process.

10. The method of claim 8 in which said metallic coating is applied by an electrolytic metallic coating application process.

11. The method of claim 8 in which said metallic coating is applied by a spray metallic coating application process.

12. The method of claim 8 in which said step of perforating said metallic sheet is practiced upon incremental lengths of said metallic sheet and said metallic sheet is indexing to provide an incremental unperforated length which may then be perforated.

13. The method of claim 8 further comprising the step of applying a coating layer to said steel sheet after said metallic coating is applied.

14. The method of claim 13 in which said step of applying a coating layer comprises the application of paint to said steel sheet by a roll paint application process.

15. A method of producing a metallic coated elongated steel sheet product comprising the steps of, in sequence:

a. perforating a fully processed, uncoated, low carbon rim cold rolled flat elongated steel sheet to provide a plurality of perforations in the web thereof;

b. passing said steel sheet through a temper rolling mill to reduce any burrs formed around the perforations and improve the surface finish and shape of said steel sheet; and c. continuously applying a metallic coating to said steel sheet.

16. The method of claim 15 in which said metallic coating is applied by a hot dip metallic coating application process.

17. The method of claim 15 in which said metallic coating is applied by an electrolytic metallic coating application process.

18. The method of claim 15 in which said metallic coating is applied by a spray metallic coating application process.

19. The method of claim 15 in which said step of perforating said steel sheet is practiced upon incremental lengths of said steel sheet and said steel sheet is indexed to provide an incremental unperforated length which may then be perforated.

20. The method of claim 15 in which said step of applying a metallic coating comprises the continuous hot dip galvanizing of said steel sheet.

21. The method fo claim 20 further comprising the step of temper rolling said steel sheet after said step of continuous hot dip galvanizing to improve the surface finish and shape and to minimize the appearance of spangles formed during galvanizing.

22. The method of claim 21 further comprising the step of applying a coating layer to said steel sheet after said sheet has been temper rolled.

23. The method of claim 22 in which said step of applying a coating layer comprises the application of paint to said steel sheet by a roll paint application process.

* * * * *

UNITED STATES PATENT AND TRADEMARK OFFICE

CERTIFICATE OF CORRECTION

PATENT NO. : 5,059,455

DATED : October 22, 1991

INVENTOR(S) : LaVurne R. Hasselbach, Donald P. Kennedy, Roger H. Montgomery, Samuel W. Moore and Jack W. Neiger It is certified that error appears in the above-identified patent and that said Letters Patent is hereby corrected as shown below:

Col. 2, line 7, after "¼" add a space.

Col. 4, line 66, after "36" add a comma.

Col. 5, line 67, after "metallic" add --elongated--.

Col. 6, line 32, after "uncoated" add a comma.

Col. 6, line 54, delete "indexing" and substitute --indexed-- therefor.

Col. 8, line 6, delete "fo" and substitute --of-- therefor.

Signed and Sealed this

Thirteenth Day of April, 1993

*Attest:*

STEPHEN G. KUNIN

*Attesting Officer*

*Acting Commissioner of Patents and Trademarks*